United States Patent [19]

Vause

[11] 3,960,278

[45] June 1, 1976

[54] LAMP CAP ASSEMBLY

[75] Inventor: Arthur Samuel Vause, London, England

[73] Assignee: Burroughs Corporation, Detroit, Mich.

[22] Filed: Nov. 7, 1974

[21] Appl. No.: 521,572

[52] U.S. Cl. ..... 339/145 R; 313/318

[51] Int. Cl.[2] ..... H01J 5/50

[58] Field of Search ..... 339/144 R, 144 T, 145 R, 339/145 D, 145 T, 146, 275 R, 275 B; 313/318

[56] References Cited

UNITED STATES PATENTS

| | | | |
|---|---|---|---|
| 665,459 | 1/1901 | Painter | 339/275 R |
| 1,702,234 | 2/1929 | Goodridge | 339/275 B |
| 2,659,836 | 11/1953 | Germer | 339/145 D |
| 2,705,311 | 3/1955 | Baker | 339/145 T |
| 2,799,795 | 7/1957 | Dickson | 339/146 |
| 2,900,492 | 8/1959 | Bosst | 339/144 R X |
| 3,322,992 | 5/1967 | Parker et al. | 313/318 UX |

FOREIGN PATENTS OR APPLICATIONS

| | | | |
|---|---|---|---|
| 881,106 | 11/1961 | United Kingdom | 313/318 |

*Primary Examiner*—Joseph H. McGlynn
*Assistant Examiner*—Howard N. Goldberg
*Attorney, Agent, or Firm*—G. Gregory Schivley; Kevin R. Peterson; Mervyn L. Young

[57] ABSTRACT

The present invention relates to electric light sources such as may be used in sealed beam lighting units. An electric lamp assembly comprises a sealed envelope containing a light source mounted in a flanged lamp cap. Terminal pins pass through hermetic seals in the cap and support the light source in a predetermined position relative to the cap flange.

4 Claims, 2 Drawing Figures

LAMP CAP ASSEMBLY

Figure 1:
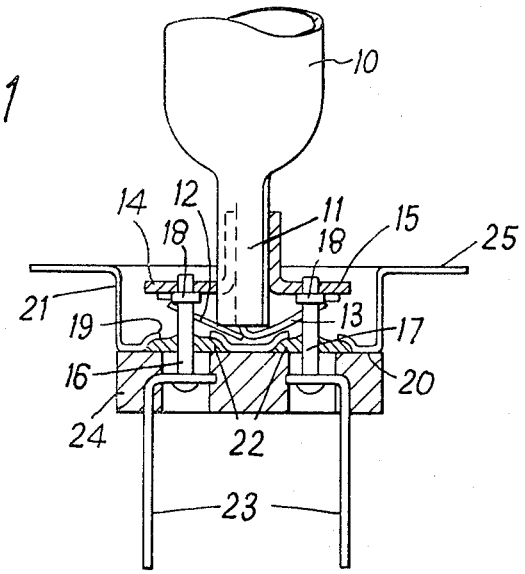

The present invention relates to lamps.

A need has arisen for a lamp of accurate construction for use in the manufacture of sealed beam lighting units and also for precision demountable systems such as projectors for slides and cine films. Whilst some manufacturers of sealed beam lighting units may be equipped to manufacture the lamps, i.e. the actual light sources, themselves, other manufacturers cannot do so and thus have to rely on outside suppliers. Even the manufacturer who can make the lamps himself may find it inconvenient to make the lamp in the same factory as where the unit is assembled.

An obstacle to the manufacture of gas-tight sealed beam lighting units, particularly those units which are of other than all-glass construction, has been the non-availability of an hermetically sealed light source assembly. It would be desirable if source assemblies having metal or plastic caps or bases were available which include means for electrically connecting the light source to an external supply as well as a reference surface to permit accurately reproducible location of the assemblies with respect to a metal or plastic reflector member.

The normally fitted types of cap are not suitable for effective gas-tight sealing into sealed-beam units. The ends of such caps remote from the lamp bulb, through which the metal electrical contact members are normally accommodated are customarily filled with insulating material of glass (Vitrite) or plastic which holds the contact members in place. Existing fill materials do not wet the usual materials from which the contact members and cap shells are made, and so rather poor bonding results. Furthermore, the fill material, contact members and cap shell do not offer matched thermal expansion characteristics. Thus, hermetic sealing between these components contact members and cap shell is not maintained over the range of temperature cycles found when operating lamps in the extremes of service conditions.

This persistent difficulty, experienced over the years with the established forms of incandescent filament lamp, becomes even more severe with more modern light-sources such as incandescent tungsten halogen or high-intensity discharge types of lamp. These operate at much higher wattage loadings per unit source volume than ordinary filament lamps and hence produce a greater temperature range between ambient and maximum operating performance levels, thus placing even greater emphasis on the design requirements for effective hermetic sealing of light units.

In accordance with the present invention there is provided an electric lamp comprising an envelope containing the light source and having a seal through which electrical leads pass and a lamp cap in which the seal is mounted, characterised in that the cap has electrically-conductive terminal pins to which the electrical leads are connected and on which the envelope seal is mechanically supported, the terminal pins pass through the wall of the cap and are hermetically sealed thereto and the lamp cap has a peripheral flange.

Figure 2:
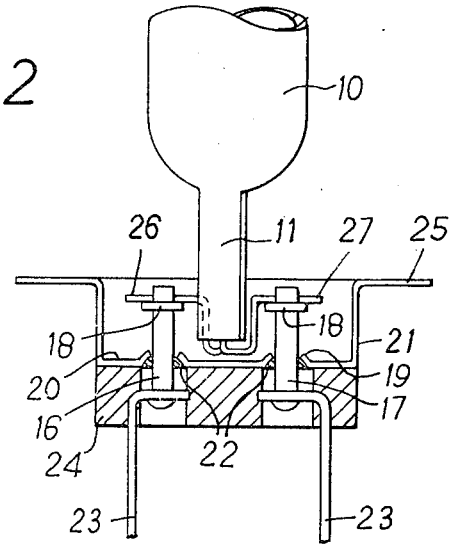

The invention will be described in more detail with the aid of examples illustrated in the accompanying drawings, in which:

FIG. 1 is a view of a lamp in accordance with the invention with the cap shown in section, and FIG. 2 is a similar view of a modification of the embodiment of FIG. 1.

The lamp shown in FIG. 1 has an envelope 10 which in conventional manner contains the light source (not shown) which may consist of one or more incandescent filaments or a set of discharge electrodes. The lamp may, for example, be a tungsten-halogen incandescent lamp or a gas, metal vapour, or metal halide discharge lamp. The vitreous envelope 10 is closed at its end by a punch seal 11 through which pass electrical leads 12 and 13. Two metal brackets 14 and 15 are fastened to the exterior of the pinch seal 11. This fastening is preferably done in the manner described in my co-pending application, Ser. No. 411,698, now U.S. Pat. No. 3,904,909, issued Sept. 5, 1975, in which parts of the bracket are embedded in or bonded to the material of the press seal while the material is still soft. The brackets 14 and 15 are fixed at a known distance from an internal reference point within the lamp envelope, such as the centre of a filament or an arc discharge path.

The brackets 14 and 15 are apertured and are secured by soldering or crimping to the heads of two terminal pins 16 and 17, respectively, which are electrically conductive and have the leads 12 and 13 respectively connected thereto. The head of each of the pins 16 and 17 has a shoulder 18 against which the bracket 14 or 15 is fastened. The terminal pins 16 and 17 pass through openings 19 in the base 20 of a cap member 21. The openings 19 are formed in coined depressions in the base 20 and each of the pins 16 and 17 is sealed in one of the openings 19 in an air-tight manner by means of an insulating mass 22. The mass 22, which is seated in the depression, is a vitreous material such as glass or a plastics sealing material of thermal expansion matching those of the pins 16 and 17 and the cap member 21.

Spade terminals 23 are soldered to the outer ends of the pins 16 and 17. The terminals 23 are moulded in situ into a base plate 24 of insulating plastics material.

The cap member 21 is circular in plan and has a shallow cup shape with an encircling peripheral flange 25 which lies in a plane parallel to the base 20. The positions of the shoulders 18 on the terminal pins are set in relation to the flange 25 such that when the brackets 14 and 15 are fastened against the shoulders the flange 25 lies in a predetermined position relative to the internal reference point within the envelope 10.

The lamp shown in FIG. 1 is suitable for use in demountable lighting systems and also for incorporation in sealed beam lighting units. In such units the reflector is provided with an opening to receive the lamp and the flange 25 is bonded directly to the reflector. The bond is made with adhesive or by soldering and providing that this bond is air-tight a hermetically-sealed lighting unit can be obtained by virtue of the seal between the pins 16 and 17 and the cap member 21.

In the construction of FIG. 2 parts corresponding to those of FIG. 1 have been given the same reference numerals and will not be further described. The brackets 14 and 15 of FIG. 1 are omitted and the mechanical support of the envelope 10 is effected by electrical leads 26 and 27 which in this case are fingers or strips integral with a sheet metal mount (not shown) which supports the internal components of the lamp and passes through the pinch seal 11. These internal components may comprise shields, reflectors, and one or more filaments or a set of discharge electrodes. The sheet metal mount may be as described in our British patent specifications Nos. 1,313,531 and 1,313,532. The leads 26 and 27 are apertured and are secured to the shouldered heads of the pins 16 and 17 in the same manner as the brackets 14 and 15 in FIG. 1.

I claim:

1. An electric lamp comprising an envelope containing a light source and having a seal through which electrical leads pass and a lamp cap in which the seal is mounted, in which the cap has electrically-conductive terminal pins to which the electrical leads are connected and on which the envelope seal is mechanically supported, the terminal pins pass through the cap and are hermetically sealed thereto and the lamp cap has a peripheral flange lying in a predetermined position relative to an internal reference point of the envelope and in which the envelope is supported on the terminal pins by way of brackets embedded in the material of the seal and attached to the pins.

2. An electric lamp as claimed in claim 1, in which the terminal pins have heads with shoulders thereon and the brackets are apertured and are fastened against the said shoulders.

3. An electric lamp comprising an envelope containing a light source and having a seal through which electrical leads pass and a lamp cap in which the seal is mounted, in which the cap has electrically-conductive terminal pins to which the electrical leads are connected and on which the envelope seal is mechanically supported, the terminal pins pass through the cap and are hermetically sealed thereto and the lamp cap has a peripheral flange lying in a predetermined position relative to an internal reference point of the envelope and in which the electrical leads also serve for the mechanical support of the envelope, said electrical leads being in the form of sheet metal strips and being apertured to fit over the ends of the terminal pins and rest against the shoulders of the pins.

4. An electric lamp comprising an envelope containing a light source and having a seal through which electrical leads pass and a lamp cap in which the seal is mounted, in which the cap has electrically-conductive terminal pins to which the electrical leads are connected and on which the envelope seal is mechanically supported, the terminal pins pass through the cap and are hermetically sealed thereto and the lamp cap has a peripheral flange lying in a predetermined position relative to an internal reference point of the envelope and in which a base plate is associated with the cap, spade terminals are embedded in the base plate, and the terminal pins are connected to the spade terminals.

* * * * *

UNITED STATES PATENT AND TRADEMARK OFFICE

CERTIFICATE OF CORRECTION

PATENT NO. : 3,960,278

DATED : June 1, 1976

INVENTOR(S) : Arthur Samuel Vause

It is certified that error appears in the above-identified patent and that said Letters Patent are hereby corrected as shown below:

On the Title Page, Item [73], please change the name of the

Assignee to:
Thorn Electrical Industries Limited
London, England

Attorney, Agent, or Firm, please change the names listed therein to:

Robert F. O'Connell

Signed and Sealed this

Eighth Day of February 1977

[SEAL]

*Attest:*

RUTH C. MASON
*Attesting Officer*

C. MARSHALL DANN
*Commissioner of Patents and Trademarks*